US010390565B1

(12) United States Patent
Mardech

(10) Patent No.: US 10,390,565 B1
(45) Date of Patent: Aug. 27, 2019

(54) SYSTEM FOR DELIVERING VAPOR DERIVED FROM ELECTRONIC CIGARETTE LIQUID

(71) Applicant: Saeed Mardech, Redding, CA (US)

(72) Inventor: Saeed Mardech, Redding, CA (US)

( * ) Notice: Subject to any disclaimer, the term of this patent is extended or adjusted under 35 U.S.C. 154(b) by 1 day.

(21) Appl. No.: 15/603,248

(22) Filed: May 23, 2017

Related U.S. Application Data

(60) Provisional application No. 62/345,351, filed on Jun. 3, 2016.

(51) Int. Cl.

| | |
|---|---|
| ***A24F 13/00*** | (2006.01) |
| ***A24F 47/00*** | (2006.01) |
| ***A24F 1/30*** | (2006.01) |
| ***A24F 1/02*** | (2006.01) |
| ***A24F 7/00*** | (2006.01) |
| ***G08C 17/02*** | (2006.01) |

(52) U.S. Cl.
CPC ..... *A24F 47/008* (2013.01); *A24F 1/02* (2013.01); *A24F 1/30* (2013.01); *A24F 7/00* (2013.01); *G08C 17/02* (2013.01)

(58) Field of Classification Search
CPC ..... A24F 47/00
USPC ..... 131/329, 328
See application file for complete search history.

(56) References Cited

U.S. PATENT DOCUMENTS

| | | | | |
|---|---|---|---|---|
| 9,078,474 | B2 | 7/2015 | Thompson | |
| 9,888,714 | B2 * | 2/2018 | Cameron | A24F 1/30 |
| 2017/0136301 | A1 * | 5/2017 | Cameron | A24F 47/008 |

FOREIGN PATENT DOCUMENTS

| | | |
|---|---|---|
| CA | 2912829 | 12/2014 |
| CN | 103647583 | 3/2014 |

* cited by examiner

*Primary Examiner* — Phuong K Dinh
(74) *Attorney, Agent, or Firm* — John P. Costello; Costello Law Corp.

(57) ABSTRACT

The invention is an improvement to electronic smoking devices which employ an elongate draw tube and mouthpiece such as a hookah or elongate draw conduit, such as a water bong. In addition, other devices such as electronic smoking modules which are typically larger and bulkier than electronic cigarettes, could benefit from the invention by making them easier to carry by attaching a draw tube.

8 Claims, 6 Drawing Sheets

SYSTEM FOR DELIVERING VAPOR DERIVED FROM ELECTRONIC CIGARETTE LIQUID

RELATED APPLICATIONS

This utility patent application claims the benefit of U.S. provisional patent application Ser. No. 62/345,351, filed on Jun. 3, 2016.

TECHNICAL FIELD

This invention relates to electronic smoking device such as electronic cigarettes, which rely on producing an inhaled vapor composition, and more particularly, to a system for instantaneously vaporizing electronic cigarette liquid.

BACKGROUND

Electronic smoking devices can encompass electronic cigarettes, electronic smoking modules, and electronic hookahs, to name some common examples. These devices rely on an e-liquid cartridge which contains a mixture of nicotine, suspension fluid and various flavorings which is heated and converted from a liquid to a vapor which is inhaled. The vapor enters the lungs of the smoker and the same effects created by smoking tobacco are produced, except without the tar and carcinogens inherent with tobacco smoking. Electronic cigarettes may be used with other substances and cartridges can potentially be filled with e-liquid substances other than nicotine; in some applications serving as a new way to deliver other drugs, for example psychoactive or psychotropic drugs such as THC. Additional generalized background on electronic smoking devices can be found on Wikipedia, for example.

A recent trend in electronic smoking devices has been to use a Bluetooth® radio frequency device to regulate various functions of electronic smoking devices. For example, Supersmoker Bluetooth® provides a Bluetooth® smoking device which allows a user to answer his telephone or play a music selection though the electronic smoking device. One product, the SMOK Bec Pro 50 Watt Bluetooth® Mod, provides Bluetooth® functionality and allows a smoker to monitor statistics and parameters of an electronic smoking device via a cell phone. Features such as output voltage, battery power level, atomizer resistance, and the amount of puffs a user has taken on any given day can be monitored.

Another trend in electronic smoking devices has been to employ modular electronic cigarette smoking devices or even larger devices such as hookahs or water bongs. In the case of some of these larger devices it is advantageous to connect an elongate draw tube attached to a mouthpiece so the smoker can enjoy electronic smoking from these devices without having to lift or move them. However, typically, these devices operate by a pressure switch where the smoker inhales on the draw tube and negative pressure causes the switch to actuate, which operates the heating element that heats the e-liquid to vapor. Pressure switches in electronic smoking applications suffer a drawback from the fact that a smoker must inhale a considerable amount of air in the draw tube before the switch is actuated and vapor reaches the smoker's lungs.

The present invention presents an improvement in the smoking experience of any electronic smoking device which uses an elongate drawtube, such as a hookah. Also, the present invention allows an elongate draw tube and mouthpiece to be attached to smoking modules which tend to be bulky and more suitable for pocket carry. In this way, the smoking module can be kept in a jacket or shirt pocket and the smoker can draw on the tube, when desired, without having to manipulate a bulky module. The elongate draw tube and mouthpiece also is constructed to cause instantaneous heating of the heating element, thus causing near simultaneous production of vapor from the electronic smoking device. This is a significant improvement over the pressure switch devices, which is the current state of the art.

The foregoing reflects the state of the art of which the inventor is aware, and is tendered with a view toward discharging the inventor's acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The invention is an improvement to electronic smoking devices which employ an elongate draw tube and mouthpiece such as a hookah or elongate draw conduit, such as a water bong. In addition, other devices such as electronic smoking modules which are typically larger and bulkier than electronic cigarettes, could benefit from the invention by making them easier to carry by attaching a draw tube.

In one embodiment of the invention, a switch on a mouthpiece attached to an elongate draw tube is hard-wired to an electronic heating element which heats the liquid in a cartridge of an electronic smoking device. The switch is placed upon the mouthpiece and actuated by the smoker, causing near instantaneous delivery of vapor to the elongate draw tube.

In another embodiment of the invention, the mouthpiece has a switch wherein the switch is coupled to a wireless transmitter and the electronic smoking device has a receiver connected to the heating element. An example of a wireless transmitter and receiver which achieves the invention purpose is a Bluetooth® wireless system. Actuating the switch on the mouthpiece causes near instantaneous production of vapor and delivery of the vapor to the elongate draw tube. The Bluetooth® actuated switch can be a clip-on variety or else it can be built into the mouthpiece.

Further objects and advantages of the invention will be brought out in the following portions of the specification, wherein the detailed description is for the purpose of fully disclosing the preferred embodiments of the invention, without placing limitations thereon.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

Figure 1:
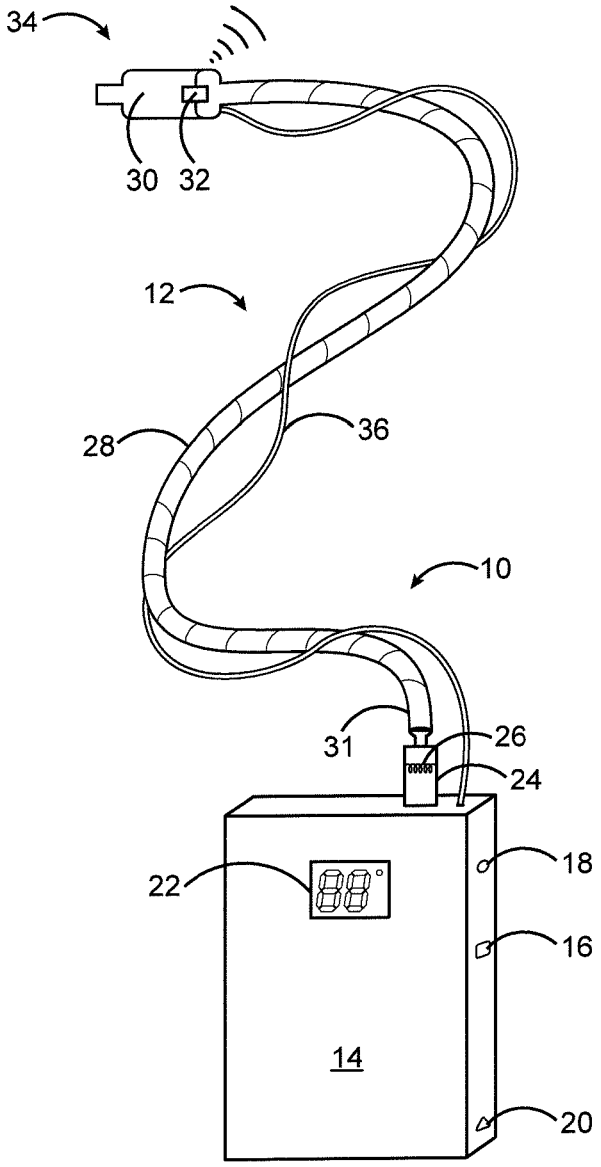
FIG. 1 is a front perspective view of a first embodiment of the invention attached to an electronic smoking module.

Referring to FIG. 1, an embodiment 10 of the system of the present invention mounted upon a modular electronic cigarette. Typically, a modular electronic cigarette 14 has more features and capabilities than a cigarette-shaped electronic cigarette. Modular units 14 are often bulky and do not lend easily to being carried around while smoking at the same time. Also, modular and electronic cigarettes have been involved in some explosion incidents which have damaged the mouths of smokers. The modular electronic cigarette's typical features include a rechargeable battery (not shown in this view) an on/off button 16, an "on" indicator light 18, and a charging port 20 for recharging the unit 14. An LCD display 22 is often included to notify the smoker that his unit is up to smoking temperature so that the electronic smoking session can begin. A cartridge 24 is attached to the unit 14 and allows the smoker to introduce a variety of electronic cigarette smoking liquids which are converted to vapor by a heating element 26. The electronic cigarette smoking liquids might contain nicotine, or not; might contain cannabis extracts or not. Either way, the electronic cigarette smoking liquids can be changed-out and smoked according to the smoker's preferences at any given time.

Up until the present inventions modular electronic cigarettes have had a mouthpiece attached directly to the cartridge like that shown in U.S. patent application Nos. 2014/0283824 (Wheelock et al.) and 2010/0163063 (Fernando et al.), so as to acquire a direct draw of vapor from the cartridge as soon as the smoker placed a draw on the mouthpiece by inhaling. This often involved a pressure switch which, when negative draw pressure was detected by the module, the element would heat automatically, converting the electronic cigarette liquid to vapor. In FIG. 1, the elongate draw tube 28 contains a volume of air, such that if a smoker draws on the mouthpiece 30 to create pressure, the volume of air occupying the interior conduit void of the draw tube will be inhaled into the mouth and lungs before encountering any vapor. This can lead to a less than satisfactory smoking experience. The present invention overcomes this problem by providing a mechanical switch 32 on the mouthpiece 30 located at the draw-end 34 of the elongate draw tube 28. The mechanical switch 32 is attached near the mouthpiece 30 at the draw end 34 of the draw tube, the switch 32 being connected to a wire 36 which communicates with the electronic cigarette module 14 and by depressing the switch 32, the circuit is closed and the heating element 26 activates, instantaneously releasing vapor into the end 31 (opposite the draw end) of the elongate draw tube 28, thus filling the interior conduit void of the draw tube with vapor. When the smoker draws, he immediately encounters vapor, rather than air inside the elongate tube due to vapor traveling instantaneously into the draw tube. This occurs as the vapor is driven forward from the vaporizing effect; the vapor naturally fills voids such as the interior conduit void of the draw tube 28. Perhaps only a couple of seconds is required for the vapor to reach the mouthpiece and then the smoker can take a draw; encountering only vapor instead of air. Also, the addition of the elongate draw tube 28 to the modular electronic cigarette module 14 reduces the risk of mouth injury due to explosions from having a smoker's face too close to the module.

Figure 2:
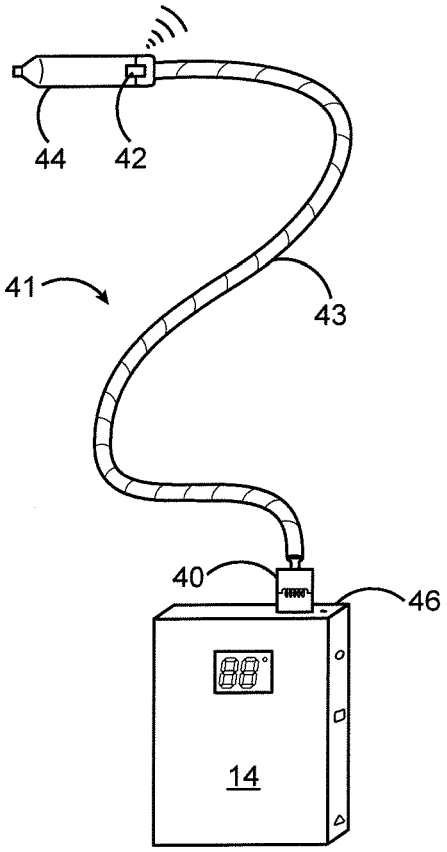
FIG. 2 is a front perspective view of a second embodiment of the invention attached to an electronic smoking module.
Figure 3:
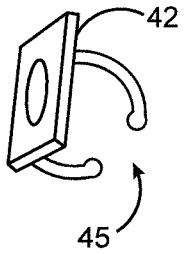
FIG. 3 is a front elevated perspective view of a mechanical switch and Bluetooth® transmitter component of the invention.
Figure 4:
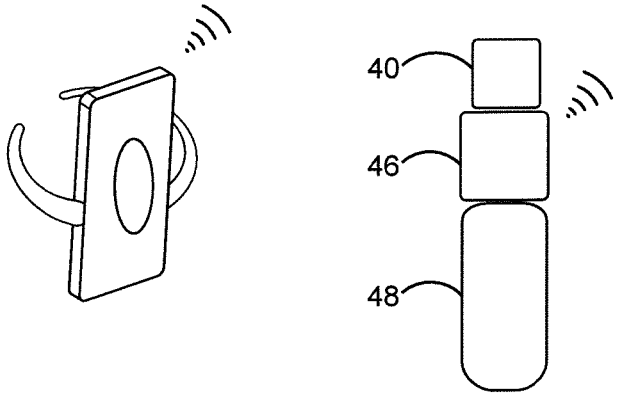
FIG. 4 is a front view of a Bluetooth® receiver unit, power supply and heating element for heating electronic cigarette liquid.

Referring now to FIG. 2, a wireless embodiment 41 of an electronic cigarette module system is shown. This embodiment has a Bluetooth® enabled heating element 40 wherein a transmitter unit 42 is located on the mouthpiece 44 attached to the draw end of the draw tube 43 and a receiver unit 46 communicates with the heating element 40 to automatically heat the element and produce smoking vapor. The Bluetooth® transmitter unit 42 can be built into the mouthpiece 44 or provided as a separate device with an attachment device 45 as shown in FIG. 3. The attachment device 45 can be a clip, a pin or adapted to be worn as a ring or a bracelet. FIG. 4 shows the components associated with the receiver unit 46, namely the associated power supply (battery) 48, and the heating element 40 which communicates with the receiver 46. The power supply 48 can be rechargeable and power all of the functions of the electronic cigarette module, including heating element 40 and the receiver unit 46.

Figure 5:
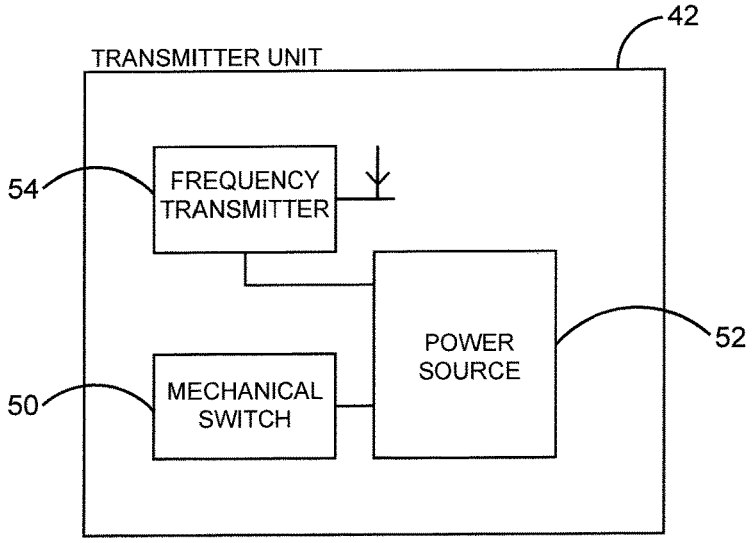
FIG. 5 is a block diagram of the transmitter unit.
Figure 6:
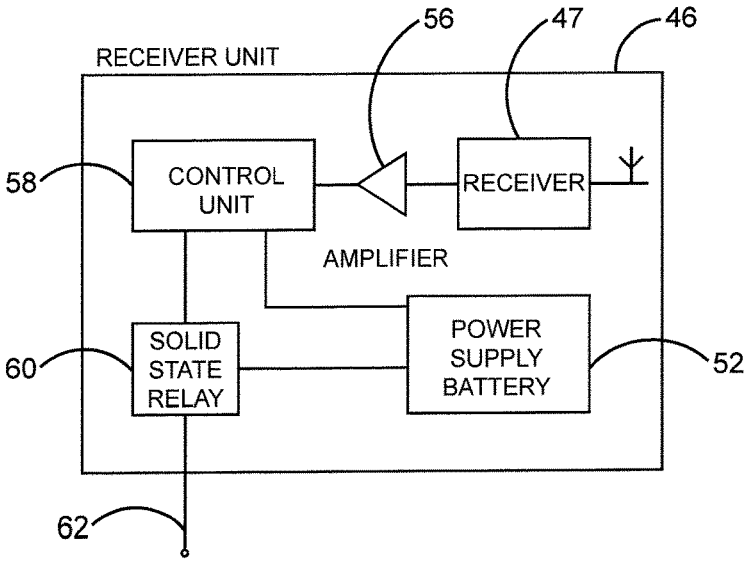
FIG. 6 is a block diagram of a receiver unit.

FIG. 5 shows the transmitter unit 42 in a block diagram format. A mechanical switch 50 is attached to the mouthpiece 44 as previously noted. Mechanical switch 50 is connected to a power supply 52 and a transmitter 54. The power supply 52 could be a small watch battery, for example. Actuating the mechanical switch 50 causes transmitter 54 to send a signal to the receiver unit 46 in the electronic cigarette module 14 to actuate the heating element 40. Referring to FIG. 6 the components of the receiver unit 46 include the receiver 47, a power supply 48, an amplifier 56, a control unit 58, a solid-state relay 60 and output line 62 to the heating element 40. The control unit 58 is programmable and can regulate the amount of energy output from the power supply 48 to the heating element 40. This feature can be an important factor to regulate depending on the type of electronic cigarette liquid being loaded into the cartridge.

Figure 7:
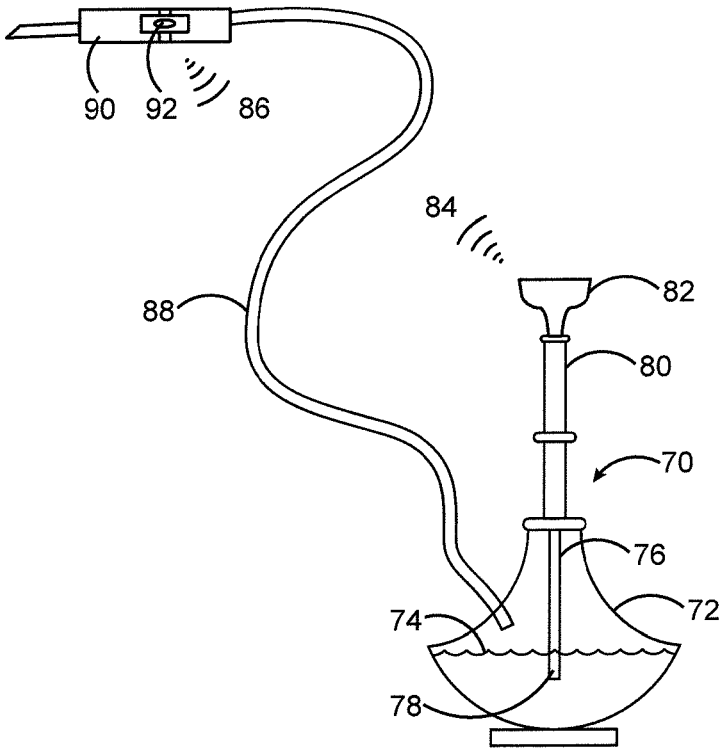
FIG. 7 is a perspective view of another embodiment of the invention being used in a hookah smoking device.

FIG. 7 shows another embodiment of the invention adapted for use with a hookah smoking device 70. The body 72 of the hookah 70 contains a level of water 74 through which electronic cigarette vapor travels down conduit 76. Conduit 76 is submerged in the water 74 at one end 78 and at the upper end 80 of the conduit is a tobacco bowl substitute device 82 which contains electronic cigarette liquid and a heating element, similar to that described for prior embodiments. A Bluetooth® receiver 84 receives a transmitted signal from the Bluetooth® transmitter 86 located in the mouthpiece. An elongate draw tube 88 or a plurality of elongate draw tubes are attached to the body 72 of the hookah 70 to allow one or more smokers to enjoy a smoking session. If a plurality of elongate tubes 88 and mouthpieces are attached to the hookah, each mouthpiece 90 has a mechanical switch 92 and Bluetooth® transmitter 86. The actuation of the mechanical switch 92 and transmitter 86 on the mouthpiece 90 causes the heating element in the bowl substitute 82 to actuate and vapor is exuded into the conduit 76 and through the interior of the hookah, and into the elongate draw tubes 88. This results in a near instantaneous receipt of electronic cigarette vapor by the smoker, leading to a hookah smoking experience very similar to a tobacco hookah in terms of vapor delivery. The bowl substitute device 82 can be friction fit or screwed on to the top of the hookah 70.

Figure 8:
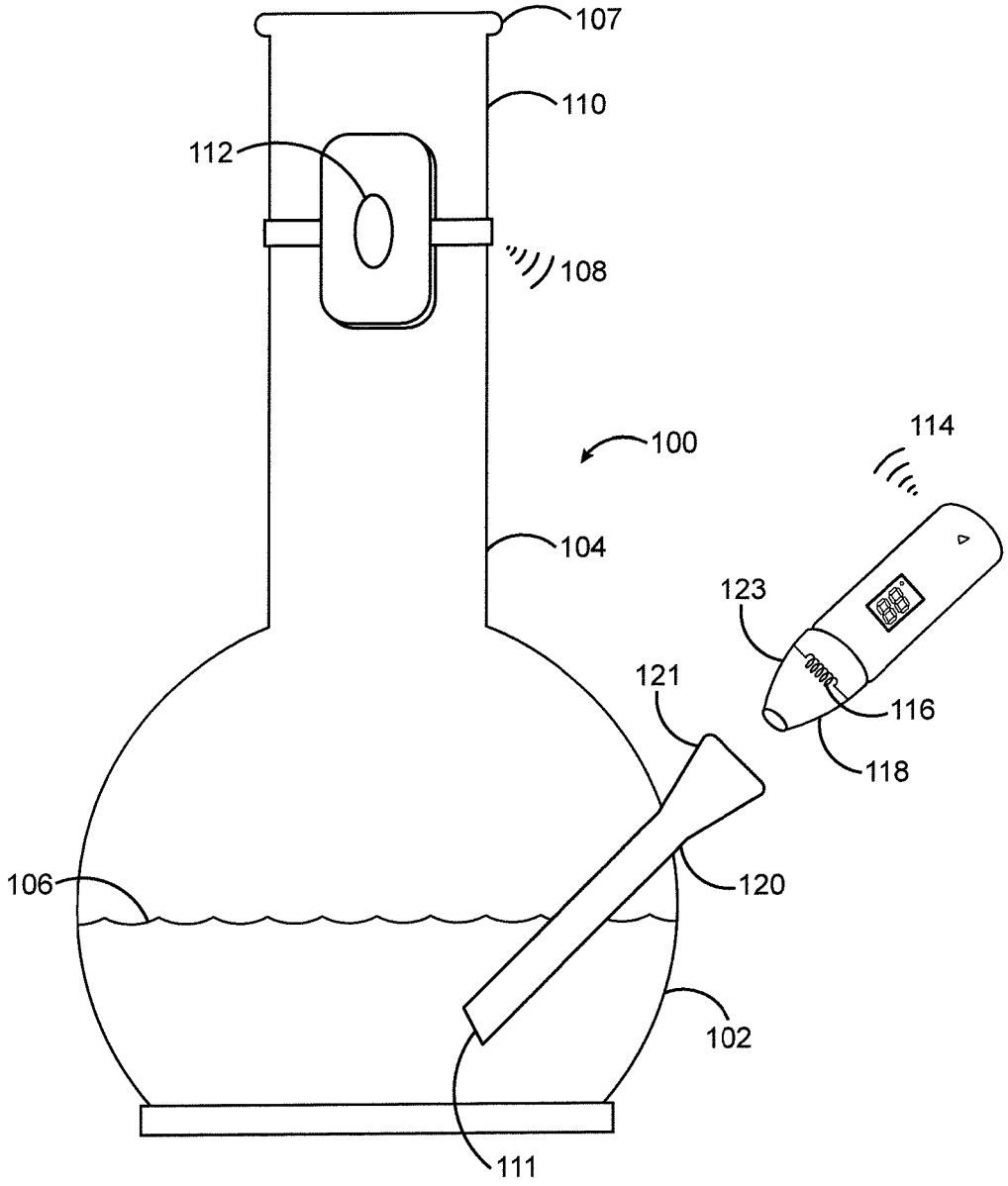
FIG. 8 is a perspective view of another embodiment of the invention being used in a water bong smoking device.

FIG. 8 illustrates yet another embodiment of the invention, this being a water bong embodiment 100. The water bong 100 has lower vessel 102 attached to, and in open communication with, an upper glass draw conduit 104, the lower vessel 102 having water 106 therein. The need for an elongate tube is eliminated because the glass draw conduit 104 serves as the vapor-drawing structure. Draw conduit 104 terminates at its upper end 110 to form a mouthpiece 107. However, the water bong 100 can benefit from an improvement in automatic delivery of vapor from a Bluetooth® transmitter and receiver. A Bluetooth® transmitter 108 is fitted to the upper end 110 of the draw conduit 104, where a smoker's hand would naturally be placed. A mechanical switch 112 actuates the Bluetooth® transmitter 108 and a Bluetooth® receiver 114 in communication with a heating element 116 of an electronic cigarette liquid cartridge 118 receives the signal from the transmitter 108. The electronic cigarette liquid cartridge 118 and receiver 108 attach to a pipe stem 120, which introduces vapor below the water line 106 from the terminus 111 of pipe stem inside of the bong 100. The pipe stem 120 has an interior conduit void that is filled with vapor when the heating element 116 of the electronic cigarette liquid cartridge 118 actuates. The vapor travels through the interior conduit void of the pipe stem 120 into the water 106 and is drawn up through the lower vessel 102, through the draw conduit 104, and into a smoker's mouth fitted over the mouthpiece 107.

The water bong 100 may be a standard water bong converted to electronic operation by attaching the transmitter to the draw conduit 104 and the receiver/electronic cigarette liquid cartridge to the bowl 121 of the bong 100. The electronic cigarette liquid cartridge can be shaped in a tapered fashion to fit a number of standard bowl interiors. The tapered sides 123 of the cartridge 118 would friction fit to the interior of the bowl of a standard bong. Additionally, it is envisioned that the bong 100 could be designed for electronic operation from the beginning. For example, the pipe stem, instead of having a bowl, would attach directly to the electronic cigarette liquid cartridge/receiver unit. The cartridge/receiver unit could attach to the pipe stem by screw threads or friction fit. Also, the cartridge 118 could be detachable from the receiver 114 so that the smoker could replace or change-out cartridges at will.

Finally, although the description above contains much specificity, this should not be construed as limiting the scope of the invention, but as merely providing illustrations of some of the presently preferred embodiments of this invention. This invention may be altered and rearranged in numerous ways by one skilled in the art without departing from the coverage of any patent claims, which are supported by this specification.

The invention claimed is:

1. An electronic smoking apparatus, the apparatus comprising:

an elongate draw tube coupled to an electronic smoking device at a one end of said elongate draw tube;

wherein said elongate draw tube has a mouthpiece coupled to a draw end of said elongate draw tube;

said elongate draw tube further comprising an interior conduit void extending from said electronic smoking device to said mouthpiece;

a radio transmitter, said radio transmitter actuated by a switch;

a radio receiver, said radio receiver in communication with said radio transmitter;

a heating element in physical contact with an electronic smoking liquid, wherein said heating element is coupled to said radio receiver;

wherein actuation of said switch causes said radio transmitter to transmit a signal to said radio receiver and causes said heating element to heat and transform said electronic smoking liquid to a vapor, said vapor traveling to and occupying said interior conduit void of said draw tube.

2. The electronic smoking apparatus as recited in claim 1, wherein said switch is coupled to said draw end of said draw tube.

3. The electronic smoking apparatus as recited in claim 2, wherein said radio transmitter is coupled to said draw end of said draw tube, said radio transmitter being actuated by said switch.

4. The electronic smoking apparatus as recited in claim 1, wherein said switch and said radio transmitter are combined as a separate device from said electronic smoking apparatus.

5. The electronic smoking apparatus as recited in claim 4, wherein said separate device further comprises an attachment device.

6. The electronic smoking apparatus as recited in claim 5, wherein said attachment device is selected from the group consisting of a clip, a pin, a finger-ring, and a bracelet.

7. The electronic smoking apparatus as recited in claim 1, wherein said electronic smoking device is an electronic cigarette module.

8. The electronic smoking apparatus as recited in claim 1, wherein said electronic smoking device is an electronic hookah.

* * * * *